US006088984A

United States Patent [19]

Kirby

[11] Patent Number: 6,088,984

[45] Date of Patent: Jul. 18, 2000

[54] METHOD AND APPARATUS FOR MAKING A SLOPED FLOOR

[76] Inventor: Mark E. Kirby, 2297 Jones Dr., Dunedin, Fla. 34698

[21] Appl. No.: 09/010,245

[22] Filed: Jan. 21, 1998

[51] Int. Cl.[7] ..... E04B 5/23

[52] U.S. Cl. ..... 52/302.1; 52/302.4; 52/302.7; 52/318; 52/742.14; 404/2

[58] Field of Search ..... 52/302.1, 302.4, 52/302.7, 318, 742.14; 404/2

[56] References Cited

U.S. PATENT DOCUMENTS

| | | | |
|---|---|---|---|
| 2,619,920 | 12/1952 | Lindquist | 52/302.1 |
| 3,501,879 | 3/1970 | Mitchell et al. | 52/302.1 |
| 5,216,767 | 6/1993 | Elmore | 4/613 |
| 5,371,980 | 12/1994 | Dix | 52/34 |
| 5,768,842 | 6/1998 | Austin | 52/302.1 X |
| 5,845,347 | 12/1998 | Young | 4/613 |

FOREIGN PATENT DOCUMENTS

| | | | |
|---|---|---|---|
| 6288027A | 11/1994 | Japan | 52/302.1 |

*Primary Examiner*—Carl D. Friedman
*Assistant Examiner*—Phi Dieu Trana
*Attorney, Agent, or Firm*—Ronald E. Smith

[57] ABSTRACT

A method for making a floor that slopes toward a drain includes the steps of enclosing a predetermined area of a flat support surface around the drain with upstanding border members, positioning an annular ring in closely spaced, concentric relation around the drain, arranging a plurality of straight form members in radial relation to the drain, connecting a radially innermost end of each form member to the annular ring so that the top edge of each form member is spaced downwardly from the plane of the drain by a distance equal to a tile thickness, and positioning an outermost end of each form member in abutting relation to the border member. Each form member has a height at its innermost end that is less than a height of its outermost end. A cementitious material is poured into the predetermined area and the material is made flush with the respective top edges of the form members. An auxiliary form member is attachable to a trailing end of each form member to increase the versatility of the method. In an alternative embodiment, the form members are self-supported by laterally-extending legs or manually held in place until the cementitious material is poured so that the annular ring is not needed.

8 Claims, 4 Drawing Sheets

METHOD AND APPARATUS FOR MAKING A SLOPED FLOOR

BACKGROUND OF THE INVENTION

1. Field of the invention

This invention relates, generally, to improvements in construction techniques. More particularly, it relates to a method and apparatus for making sloped concrete floors of the type found in showers and swimming pools, for example.

2. Description of the Prior Art

Skilled craftsmen can build a shower floor or other sloped concrete surface so that the floor slopes evenly toward a drain. However, even the most skilled craftsman cannot reproduce the same slope on different days. As a result, some homeowners get shower floors that are sloped a little too steeply and some get floors that don't quite slope enough. If the floor is too steep, the homeowner can feel uncomfortable standing in the shower. A floor that is not steep enough drains poorly.

Due to the difficult nature of sloped concrete floor construction, skilled craftsmen in the field charge a premium for their work. Thus, there would be a benefit to consumers if a new construction technique could be found that could be performed by substantially unskilled labor.

There is a need, therefor, for a construction technique that would consistently produce shower floors having an ideal slope while at the same time reducing the cost of such floors.

However, in view of the art considered as a whole at the time the present invention was made, it was not obvious to those of ordinary skill in this art how the needed improvements could be provided.

SUMMARY OF THE INVENTION

The longstanding but heretofore unfulfilled need for an apparatus that overcomes the limitations of the prior art is now met by a new, useful, and nonobvious invention. The present invention includes a novel method for making a sloping floor that slopes toward a drain. The method includes the steps of defining a predetermined area of a substantially flat support surface including the drain by positioning on the support surface an upstanding border wall of predetermined height in enclosing relation to the predetermined area. In a preferred embodiment, an annular ring or equivalent structure is positioned around the drain in closely spaced, concentric relation thereto, and a plurality of straight form members are arranged in radial relation to the annular ring. A radially innermost end of each of the form members is connected to the annular ring so that an upper edge of each of the form members is spaced downwardly from a plane of the drain by a distance substantially equal to a tile thickness. However, the annular ring or equivalent structure may be eliminated and the straight form members may be held in their respective operative positions by some other means. For example, the straight form members may be manually held in radial relation to the drain, or said straight form members may be provided with legs that hold them upright in their respective functional positions.

Each form member is sized so that it has a radially outermost end disposed in abutting relation to the upstanding border wall, and each form member is dimensioned so that the respective radially innermost ends thereof have a common height extent less than a common height extent of the respective radially outermost ends thereof.

A predetermined quantity of a cementitious mixture is introduced into the predetermined area, and the cementitious mixture is worked so that an upper surface thereof is flush with a top edge of each of the form members along the entire extent of the form members. Thus, if the form members are manually held in their operative position, they are simply released after the cementitious mixture has been poured into the area bounded by the border wall.

Where the shape or size of an application does not lend itself to construction using only the form members, auxiliary form members are employed. Specifically, a radially innermost end of an auxiliary form member is attached to a radially outermost end of a preselected form member. The auxiliary form member has an innermost end having a predetermined height extent substantially equal to the predetermined height extent of the radially outermost end of the preselected form member and the auxiliary form member has a radially outermost end having a predetermined height extent greater than the predetermined height extent of its radially innermost end.

It is a primary object of this invention to provide a construction technique for making sloped concrete floors, whether for a shower, a pool, or the like, in a consistent manner.

Another object is to provide such a technique that can be performed by substantially unskilled labor.

Still another object is to provide a technique that is flexible and thus not restricted to any particular shape of floor.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
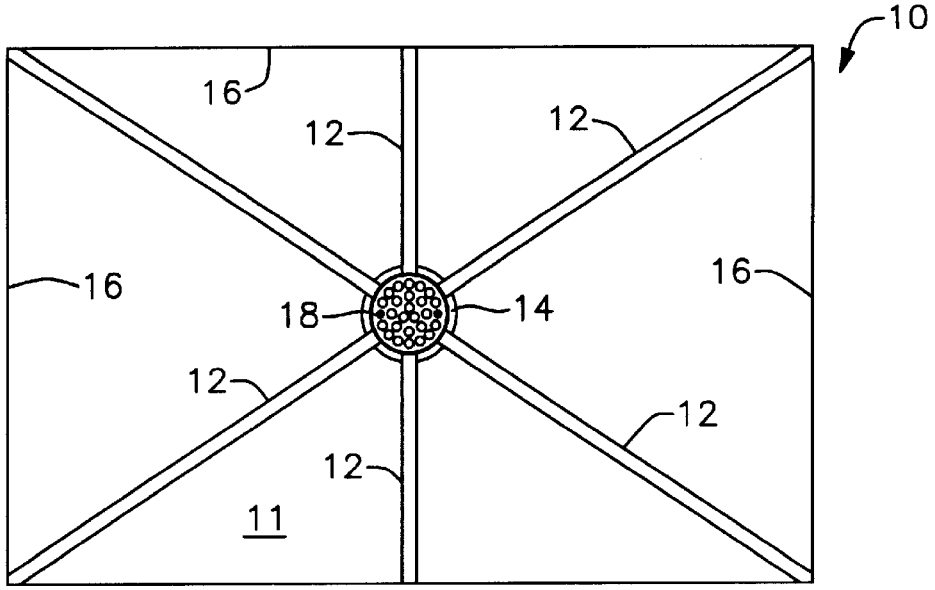
FIG. 1 is a top plan view depicting a plurality of the novel float sticks having their respective innermost ends connected to an annular support ring.

Referring now to FIG. 1, it will there be seen that an exemplary embodiment of the invention is denoted as a whole by the reference numeral 10.

The novel apparatus includes a plurality of straight float sticks, collectively denoted 12, having their respective radially innermost ends detachably connected to annular ring 14. Float sticks 12 are referred to in the claims that follow as form members. Their respective outermost ends abut an upstanding wall 16 that defines the outermost boundaries of the shower, swimming pool, or other sloped floor to be constructed. Float sticks 12 are supported by substantially flat support surface 11 which in most cases would be the slab of the structure within which the shower is being built.

It should be understood that the novel apparatus is not restricted to sloped floors of rectangular configuration only; as will become more clear as this description proceeds, the novel float sticks 12 may be used to build sloped floors of any predetermined goemetric configuration. More particularly, a float stick may be cut at any location along the length thereof to conform it to the size of a space having an extent less that the length of an uncut float stick, and the leading end of one or more auxiliary float sticks may be attached to the trailing end of an installed primary float stick to enable use of said float sticks in spaces having an extent greater then the length of a single float stick.

Figure 3:
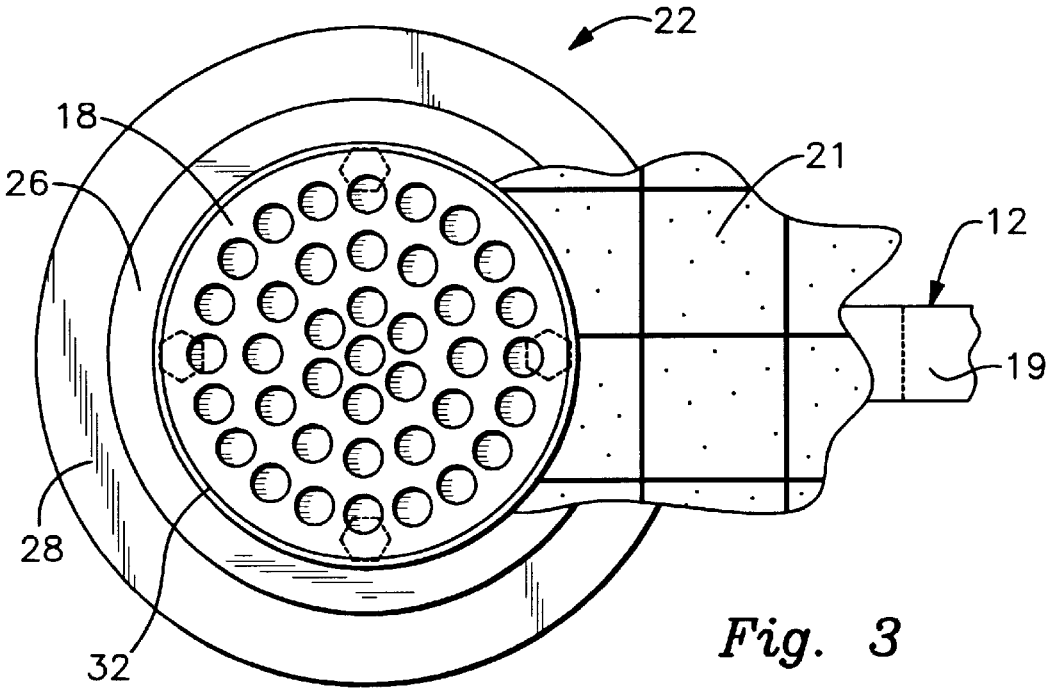
FIG. 3 is a top plan view of a shower drain and adjacent flooring built in accordance with the steps of the novel method.
Figure 4:
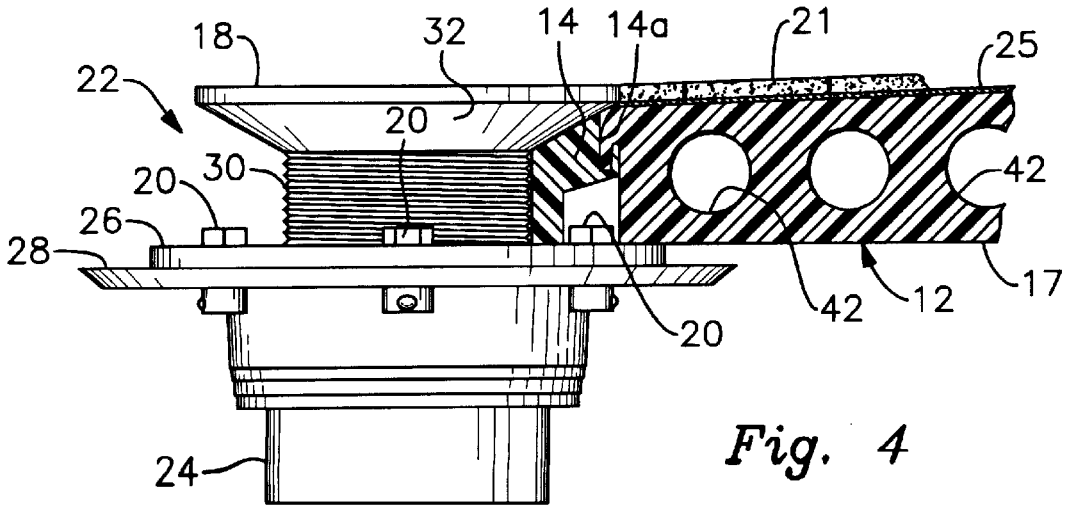
FIG. 4 is a side elevational, partially sectional view of the parts depicted in FIG. 3.

As best understood in connection with FIG. 4, annular ring 14 has an uppermost edge 14*a* that is recessed about a quarter inch or so below the surface of an apertured drain plate 18 that is flush with tiling 21 or other suitable surface when the novel method has been completed. Ring 14 may rest atop a plurality of circumferentially spaced apart screws, collectively denoted 20, or have voids formed therein to accommodate said screws as depicted in FIG. 4. Screws 20 form a part of a conventional drain assembly which is denoted 22 as a whole in FIGS. 3 and 4. Part 24 (FIG. 4) is a drain pipe and parts 26, 28 are abutting flanges that are secured to one another by said screws 20. Flange 26 is internally threaded and screw threadedly receives externally threaded post 30 which is integrally formed with housing 32 which receives said drain plate 18. Drain plate 18 and the parts denoted 22 as a whole form no part of the invention per se; they are depicted merely to indicate a typical environment within which the novel assembly is used.

Figure 2:
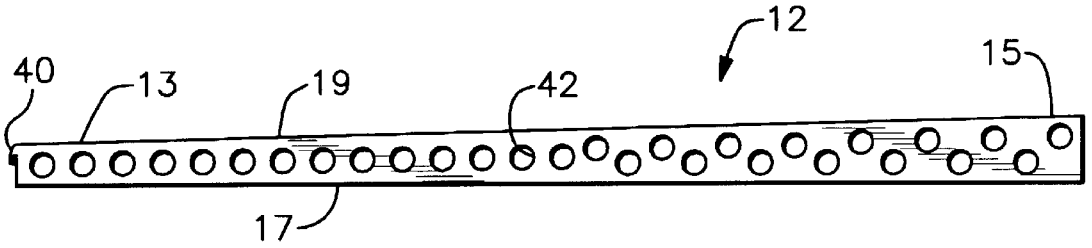
FIG. 2 is a side elevational view of one of the novel float sticks.

As best understood in connection with FIG. 2, each float stick 12 has a height extent at its radially innermost end 13 that is less than its height extent as its radially outermost end 15. Accordingly, when its bottom wall or bottom edge 17 rests atop substantially flat support surface 11 and when its radially innermost end is connected to annular ring 14, the top wall or top edge 19 of the float stick will be disposed relative to a horizontal plane at a predetermined angular slope defined by said height difference.

In a preferred embodiment, each float stick 12 is three feet in length, about two inches in height at its radially outermost end 15, and about an inch and a quarter in height at its radially innermost end 13. Those dimensions translate to a one-quarter inch drop per linear foot from the outermost end of the float stick to its innermost end. This is the slope required by most specifications because it drains well but does not feel uncomfortably steep to a person standing thereon. Other predetermined slopes are of course within the scope of this invention.

As depicted in FIG. 4, a ring 14-engaging means is formed in the radially innermost end of each float stick 12; reference numeral 40 identifies said ring-engaging means in FIG. 2 but said reference numeral does not appear in FIG. 4 to avoid cluttering that Fig. Those of ordinary skill in the mechanical arts will appreciate that the number of possible mechanical connection means that could be designed to facilitate detachable connection of said radially innermost end of said float stick 12 to ring 14 is virtually unlimited. It should therefore be understood that this simple connection means is disclosed merely for exemplary purposes and the invention is not limited to this particular attachment means. The attachment means need not be of the detachable type, since float sticks 12 are left in place after they have been attached to ring 14, but a detachable connection means is preferred so that the float sticks can be repositioned as needed when the sloped floor is under construction. Moreover, ring 14 itself may be eliminated as mentioned earlier, in which case float sticks 12 may be provided with legs that extend laterally from bottom edge 17 so that said float sticks stand in their respective functional positions without ring 12. Alternatively, such laterally-extending legs could also be eliminated and the float sticks could be manually held into position until the cementitious mixture is poured as aforementioned. Ring 14, if used, could also be formed into many shapes other than circular.

Openings 42 formed in each float stick 12 enhance the bond between the float stick and the cementitious mixture that is used to form the sloped floor.

Figure 5:
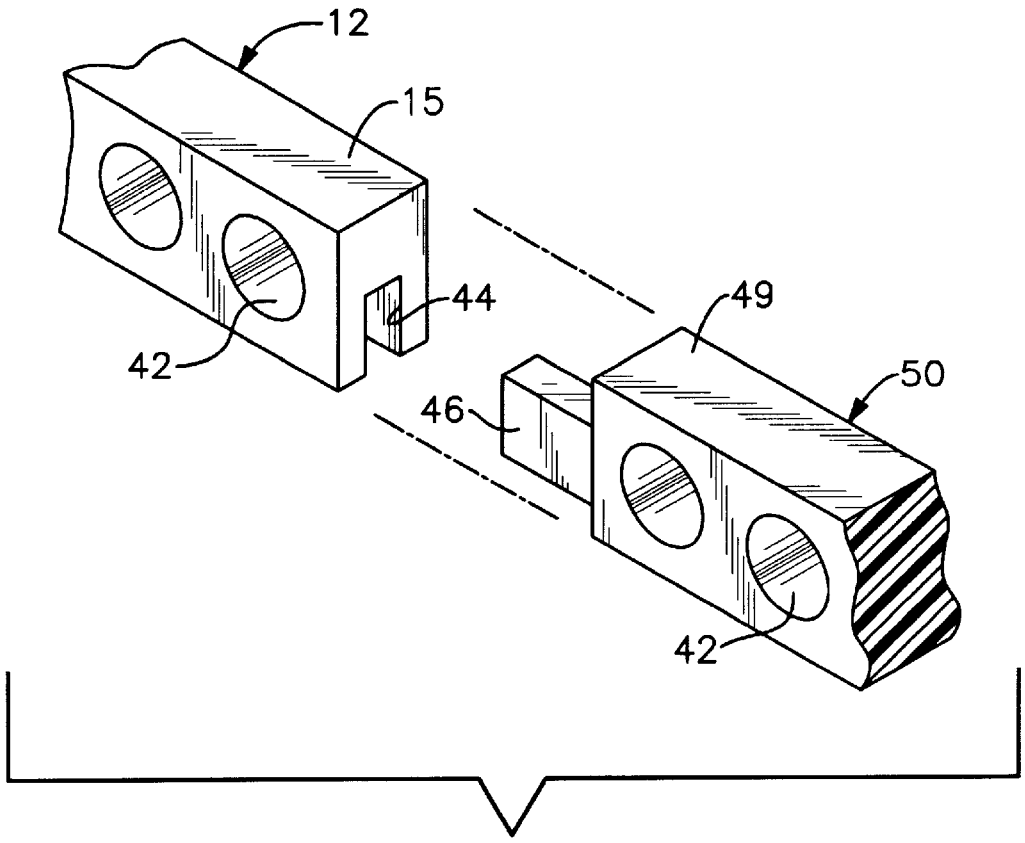
FIG. 5 is a perspective view depicting the trailing and leading ends of the novel float sticks.
Figure 6:
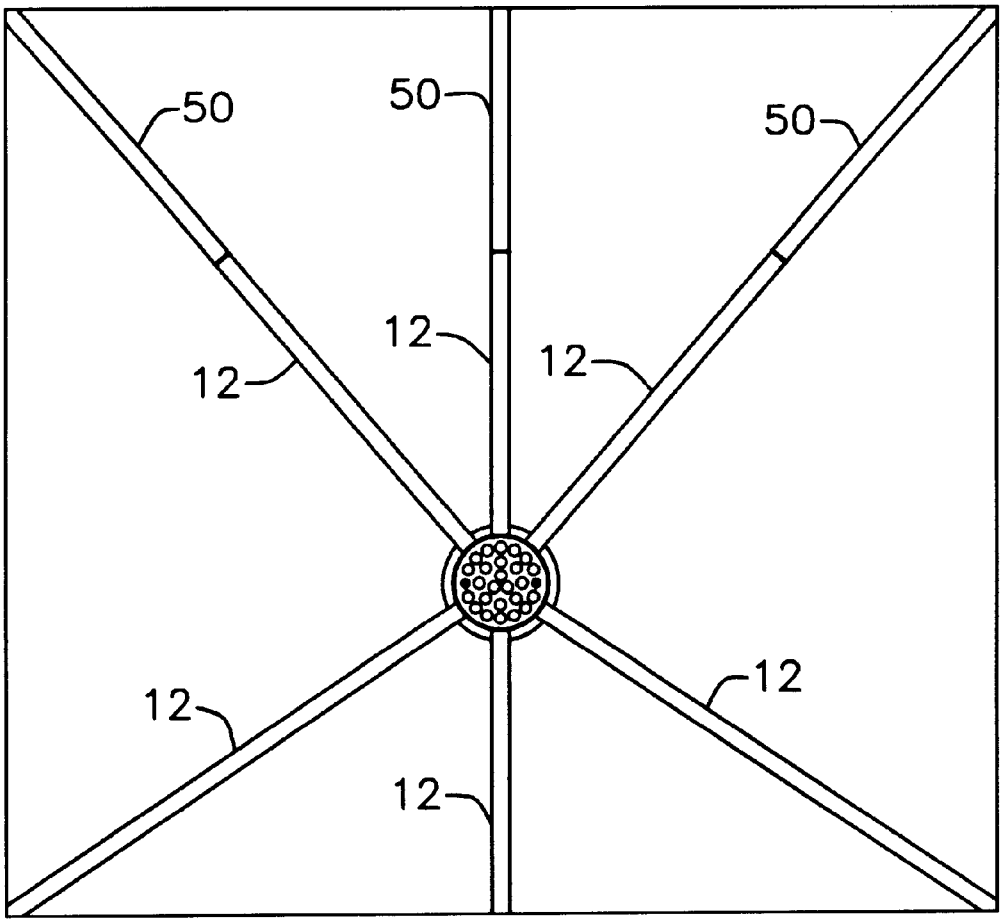
FIG. 6 is a top plan view of a shower floor made by interconnecting primary and auxiliary float sticks together in end-to-end relation to one another.

Referring now to FIG. 5, it will there be seen that a groove 44, which may be of any predetermined functional configuration, is preferably formed in the trailing (radially outermost) end 15 of each primary float stick 12 to receive a mating tounge 46 formed at the leading (radially innermost) end 49 of an auxiliary float stick 50. The leading or radially innermost end 49 of each auxiliary float stick 50, in this particular example, has a height extent of two inches so that it is flush with the outermost end 15 of the primary float stick 12 when tongue 46 is slidingly received within groove 44. The height extent at the radially outermost end of auxiliary float stick 50 (said radially outermost end not shown) is three quarters of an inch more, to maintain the above-mentioned quarter inch slope per linear foot (assuming an auxiliary float stick of three feet in length). The use of auxiliary float sticks 50 enables the building of larger sloped floors, as indicated in FIG. 6, it being understood that any number of auxiliary float sticks can be added as needed to extend the effective length of a primary float stick 12, and that any auxiliary float stick can also be cut to a shorter length whenever required. The only physical requirement is that the height extent of the radially innermost end 49 of an auxiliary float stick 50 must be substantially equal to the height extent of the radially outermost end 15 of a primary float stick 12 to which it is connected, in linear or end-to-end relation, and that the above-set forth slope requirements be maintained, i.e., that the height extent of each float stick increase about one quarter of an inch for each foot of its extent.

To perform the novel method with the above-described novel parts, drain pipe housing 32 (FIG. 4) is first unscrewed from flange 26, if needed, so that ring 14 may be positioned atop screws 20 or said flange 26. The only requirement is that ring 14, if used, be sized such that when a float stick 12 is connected thereto, the upper edge 19 of such float stick is about a quarter inch below the plane of drain cover 18 as mentioned earlier. Thus, tiles 21 will be flush with said drain cover 18 when the novel installation is complete, as depicted in FIG. 4 (reference numeral 25 indicating the cementitious "mud" that underlies each tile 21). The respective radially innermost ends 13 of the primary float sticks 12 are then engaged to ring 14 so that their respective upper edges 19 are just below the plane of drain cover 18 as aforesaid. Auxiliary float sticks 50 are used if required by the application. For example, auxiliary float sticks 50 are used if the sloped floor is oversized (relative to the length of float sticks 12) as depicted in FIG. 6 or if the sloped floor has an "L"-shaped or other relatively unusual geometric configuration that is not constructable with primary float sticks 12 alone.

When all float sticks have been installed, a suitable cementitious mixture is introduced into the area bordered by upstanding side walls 16 and divided by the upstanding float sticks and said cementitious mixture is spread throughout said area until said cementitious mixture is flush with the top edge 19 of each float stick along its extent. Excess cementitious mixture is removed and the surface is smoothed by conventional, well-known concrete working techniques that need not be described here. Tile pieces 21 having a thickness substantially equal to the distance from the plane of the drain cover to the respective top edges of the float sticks are then installed atop a relatively thin layer of mud 25 that overlies the cementitous mixture in the well-known way and the job is completed by filling the cracks between the tile with grout in the well-known way.

It should be apparent that an unskilled laborer can measure float sticks 12 and cut them to length if required, or connect auxiliary float sticks 50 to the primary float sticks 12 and cut them to length if required, and position the primary float sticks atop slab 11 with the respective radially innermost ends 13 thereof secured to ring 14 or otherwise radially positioned relative to the drain. No special skills are then required to introduce a cementitious mixture into the area bounded by upstanding walls 16 and to smooth the mud until it is flush with the top edges of the float sticks, thereby ensuring an optimal slope in the finished sloping floor. In this way, sloping floors are provided in showers or other rooms having floors that slope to a drain, swimming pools, and the like. Significantly, the slope will always be perfect and the same results will be duplicated each time the novel apparatus is used and the steps of the novel method are followed, even if the sloping floor is built by unskilled laborers.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A sloping floor being supported by a flat support surface, comprising:

a drain a plurality of elongate form members of straight configuration;

each of said form members having a first end disposed in closely spaced, concentric relation to said drain;

each of said form members having a second end abutting an upstanding border wall defining a predetermined area that includes said drain;

said first end of each form member having a predetermined height extent that is less than a predetermined height extent of each second end of said form members;

each of said form members having a bottom edge that is supported along its extent by said flat support surface; and each form member first end being positioned below a plane of said drain by a distance substantially equal to a tile thickness;

whereby said floor slopes toward said drain and is built by positioning said form members in radial relation about said drain, abutting said second ends of said respective form members to said upstanding border wall, adding a predetermined quantity of a cementitious material into said predetermined area, and making an upper surface of said cementitious material flush with the respective top edges of said form members.

2. The apparatus of claim 1, further comprising at least one auxiliary form member of straight configuration, said auxiliary form member having a first end having a predetermined height extent equal to said predetermined height extent of said second end of said form member and said auxiliary form member having a second end having a predetermined height greater than the predetermined height of said first end of said auxiliary form member.

3. The apparatus of claim 2, further comprising an attachment means formed in said second end of said form member and a mating attachment means formed in said first end of said auxiliary form member so that said auxiliary form member is attachable to said form member in linear alignment therewith.

4. The apparatus of claim 3, further comprising at least one hole formed in said form member, said hole having an axis transverse to a longitudinal axis of said form member, and said hole facilitating bonding of said cementitious material to said form member.

5. The apparatus of claim 4, further comprising at least one hole formed in said auxiliary form member, said hole having an axis transverse to a longitudinal axis of said auxiliary form member, and said hole facilitating bonding of said cementitious material to said auxiliary form member.

6. The apparatus of claim 1, wherein said form member is formed of a cuttable material so that it may be sized to fit a particular application.

7. The apparatus of claim 1, wherein said auxiliary form member is formed of a cuttable material so that it may be sized to fit a particular application.

8. The apparatus of claim 1, further comprising an annular ring disposed in encircling, concentric relation to said drain, and further comprising an annular ring attachment means formed at respective radially innermost ends of said form members.

* * * * *